US008454316B2

(12) United States Patent
Svensson

(10) Patent No.: US 8,454,316 B2
(45) Date of Patent: Jun. 4, 2013

(54) RADIAL BLADE WHEEL

(75) Inventor: Rune Svensson, Huskvarna (SE)

(73) Assignee: Flakt Woods AB (SE)

( * ) Notice: Subject to any disclaimer, the term of this patent is extended or adjusted under 35 U.S.C. 154(b) by 779 days.

(21) Appl. No.: 12/596,808

(22) PCT Filed: Apr. 17, 2008

(86) PCT No.: PCT/IB2008/051472

§ 371 (c)(1),
(2), (4) Date: Feb. 8, 2010

(87) PCT Pub. No.: WO2008/129475

PCT Pub. Date: Oct. 30, 2008

(65) Prior Publication Data

US 2010/0150721 A1 Jun. 17, 2010

(30) Foreign Application Priority Data

Apr. 20, 2007 (FI) ..... 20075277

(51) Int. Cl.
*F04D 29/28* (2006.01)

(52) U.S. Cl.
USPC ..... 416/185; 416/186 R; 416/187; 416/188; 416/223 B; 416/DIG. 2

(58) Field of Classification Search
USPC ..... 416/185, 186 R, 187, 188, 223 B, 416/DIG. 2
See application file for complete search history.

(56) References Cited

U.S. PATENT DOCUMENTS 4,362,468 A * 12/1982 Nishikawa et al. ..... 416/186 R
4,647,271 A * 3/1987 Nagai et al. ..... 416/186 R
4,666,373 A * 5/1987 Sugiura ..... 416/185
6,769,876 B2 * 8/2004 Sakai et al. ..... 416/187

* cited by examiner

*Primary Examiner* — Igor Kershteyn
(74) *Attorney, Agent, or Firm* — David I. Roche; Baker & McKenzie LLP

(57) ABSTRACT

This invention relates to a radial blade wheel comprising a first (1,1') and a second (2,2') end plate arranged at a mutual distance from each other, the first end plate having an opening (6) which allows inflow to the radial blade wheel, and blades (3) arranged between the first and the second end plate. To achieve optimal efficiency for the radial blade wheel, the radial blade wheel comprises an inner part with blades, in which curvature (R1) of the blades (3) is shaped to bring motion energy to the flowing particles while the radial blade wheel is rotating, and an outer part with blades, in which curvature (R2) of the blades (3) is shaped not to bring motion energy to the flowing particles while the radial blade wheel is rotating.

10 Claims, 3 Drawing Sheets

RADIAL BLADE WHEEL

TECHNICAL FIELD

This invention relates to a radial blade wheel and particularly to shaping of the outer part of a radial blade wheel.

BACKGROUND OF THE INVENTION

It is known to form a radial blade wheel with end plates having an outer diameter which is greater than the outer diameter of the blades. This means that the end plates protrude farther than the blades from the rotation axis of the radial blade wheel, whereby an outer space is formed which does not comprise blades. In this solution, the blades are formed in such a way that when the radial blade wheel is rotating, the blades bring, over their whole length, motion energy to the particles flowing along the blades.

An outer space without blades forms a rotating diffuser. The distance between the end plates may increase in the diffuser space in the direction away from the rotation axis. This contributes to decreasing the flow velocity, whereby the outflow velocity from the radial blade wheel is decreased.

A disadvantage with the above radial blade wheel is that the performance of the blade wheel is not optimal.

BRIEF DESCRIPTION OF THE INVENTION

An object of this invention is to provide a radial blade wheel of a novel type, the performance of which is better than in the known solutions. This is achieved with a solution according to claim 1.

In accordance with the invention, the curvature of the blades is formed in such a way that an inner part with blades comprises blades whose curvature brings motion energy to the flowing particles while the radial blade wheel is rotating, whereas an outer part with blades comprises blades whose curvature does not bring motion energy to the flowing particles while the radial blade wheel is rotating. The outer part thus forms a return part with blades which contributes to improving the performance of the radial blade wheel.

In a preferred embodiment according to the invention, the distance between the end plates increases at least in part of the outer part with blades. Thus, a lower outflow velocity is achieved from the radial blade wheel, which results in greater efficiency and the radial blade wheel being more suitable to be mounted in apparatuses. The distance between the end plates can be increased by curving or bending one end plate or alternatively both end plates at an angle relative to each other. Owing to the blades in the outer part, the bend or angle may be greater than in known solutions without the flow loosing contact with the end plates because of the bend or angle.

Preferred embodiments of the radial blade wheel are described in the dependent claims.

BRIEF DESCRIPTION OF THE INVENTION

In the following, the invention will be described by way of examples and with reference to the attached figures, of which FIG. 1 illustrates shaping of the blades of a radial blade wheel according to an embodiment of the invention FIG. 2 illustrates the blade angles of the radial blade wheel of FIG. 1 in greater detail FIG. 3 is a diagram indicating the proportion of the blade angle to the diameter of the radial blade wheel of FIGS. 1 and 2

DESCRIPTION OF AT LEAST ONE EMBODIMENT

Figure 1:
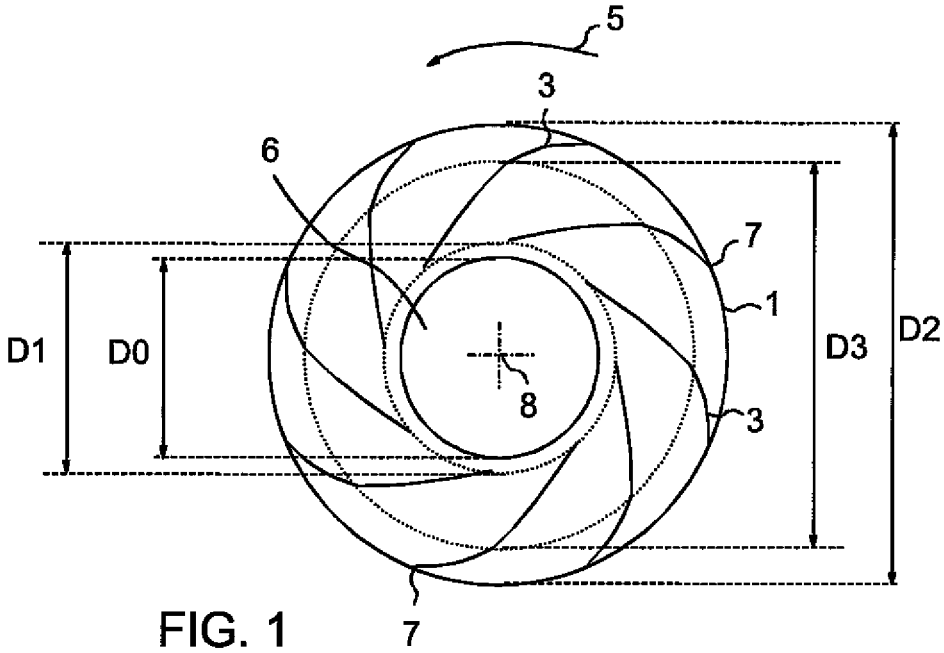

FIG. 1 illustrates shaping of a radial blade wheel according to an embodiment of the invention. FIG. 1 shows a first end plate 1 and blades 3 joining thereto. A second end plate has been omitted in order for the shape of the blade to become apparent from the figure. When a radial blade wheel is operated, it is rotated around a rotation axis 8 in the direction of an arrow 5, whereby the inflow takes place through an opening 6 in the first end plate 1, the outflow taking place through openings delimited by outer edges 7 of the blades 3 and the first and the second end plate.

Figure 2:
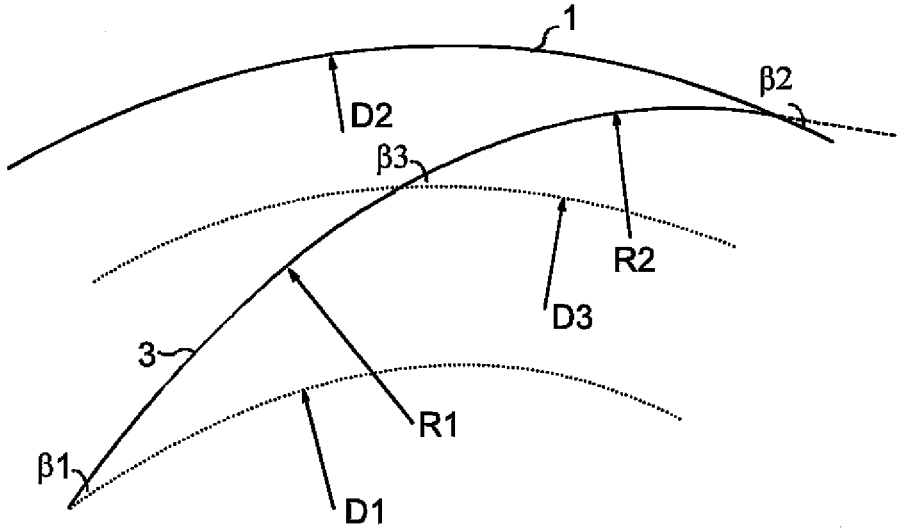
Figure 3:
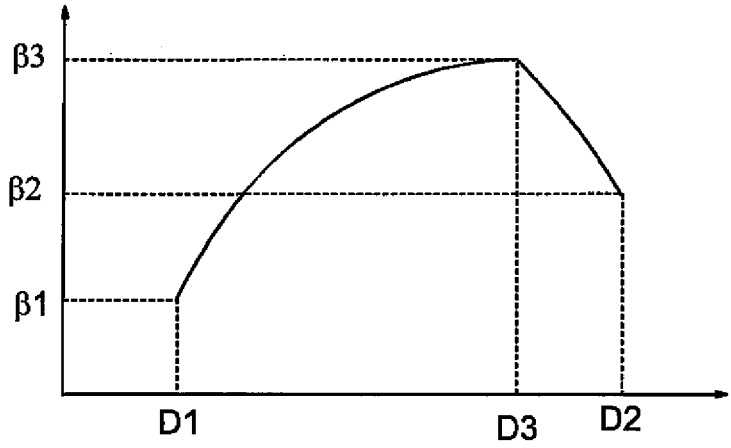

FIG. 2 illustrates the blade angle of the radial blade wheel of FIG. 1 in more detail, and FIG. 3 shows a diagram indicating the proportion of the blade angle to the diameter of the radial blade wheel of FIGS. 1 and 2.

The radial blade wheel is divided into an inner part and an outer part, whereby the transition of the inner and the outer part takes place at the point of a diameter D3. The blades of the inner part are shaped to bring motion energy to the flowing particles while the radial blade wheel is rotating. Thus, shaping similar to that of known radial blade wheels may be used for the inner part. In the example of the figures, this has been achieved with a blade angle which increases along with the distance from the rotation axis 8 of the radial blade wheel. As becomes most apparent from FIG. 3, the blade angle increases starting from inlet angle β1 at the diameter D1 of the inner part until the greatest blade angle β3 is achieved at diameter D3. As becomes apparent from the figures, the blade angle means, at a given point, an angle formed between the tangent of the blade curvature and the tangent of a circle imagined through the point when the centre of the circle is at the rotation axis of the radial blade wheel.

In the outer part after the diameter D3, the curvature of the blades is formed not to bring motion energy to the flowing particles while the radial blade wheel is rotating. Hence, in the outer part, where pressure return takes place, no energy is added. This means that an air particle carried from one point of the blade to the next does not receive energy from the blade. Such an outer part where the blade is rendered inefficient is obtained when:

$$U*Cu=\text{constant},$$

where U is the circumferential velocity, and Cu is the absolute velocity of a particle, projected in the direction of the circumferential velocity.

In the example shown in FIGS. 1 to 3, the blades 3 of the outer part are provided with curvature in which the blade angle decreases along with the distance from the rotation axis 8 of the radial blade wheel. It becomes most apparent from FIG. 3 that the blade angle decreases from angle β3 at the diameter D3 until angle β2 is achieved at the diameter D2, where the outer edge 7 of the blades is. The final outlet angle β2 depends on how large a part, radially seen, is reserved for the outer part with blades.

In practice, it is possible to form the blades of the radial blade wheel in such a way that the blades 3 have been shaped to curve according to a first radius R1 in the inner part and according to a second radius R2 in the outer part.

The practical experiments carried out with a radial blade wheel according to FIGS. 1 to 3 have indicated that good performance is achieved with such a proportion of the inner part to the outer part in which the outer diameter D2 of the outer part is 10% to 20% greater than the diameter D3, where the inner part turns into the outer part. When the outer diameter D2 is 14% greater (D2=1.14*D3), the pressure curve is approximately 30% greater than in known radial blade wheels.

Figure 4:
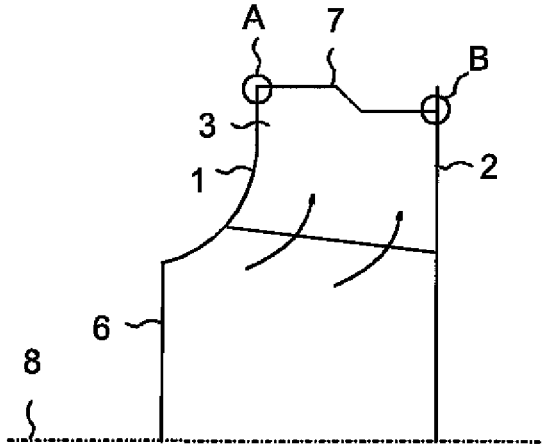
FIG. 4 is a cross-section of the radial blade wheel according to FIG. 1

FIG. 4 is a cross-section of the radial blade wheel according to FIG. 1. The figure shows only the upper half of the radial blade wheel. FIG. 2 shows the first and the second end plate 1 and 2 arranged at a mutual distance from each other, the first end plate 1 having an opening 6 allowing inflow to the radial blade wheel. As indicated by arrows, flowing continues radially outwards towards the outer edges 7 of the blades 3, which together with the first and the second end plate 1 and 2 delimit the openings allowing the outflow from the radial blade wheel. The second end plate 2 preferably comprises a fastening device positioned at the centre for fastening the radial blade wheel to an actuator, for instance a motor, by means of which the radial blade wheel can be rotated around the rotation axis 8.

As becomes apparent from FIG. 4, the outer portions of the end plates 1 and 2 (uppermost in FIG. 4) are parallel, whereby the distance between them remains constant. The end plates are in this example dimensioned in such a way that they do not extend, radially seen, outside the outer edges 7 of the blades 3. Owing to such shaping, the radial blade wheel lacks the outermost bladeless space used as a rotating diffuser in known radial blade wheels. Consequently, the outer diameter of the radial blade wheel remains optimally small in relation to the performance achieved.

According to the invention, it is feasible that the first end plate 1 and/or the second end plate 2 extend(s) slightly outside the outer edge 7 of the blade 3. Thus, in the outermost portion of the end plate/plates, a border (straight, curved or bent) is formed with which the structure can be made sufficiently stiff. In such a case, it is most often sufficient that the outer diameter of the end plates is 1 to 2.5% greater than the outer diameter D2 of the blades, which has an extremely small effect on the operation and result.

As seen from FIG. 4, point A, where the first end plate 1 meets the outer edge 7 of the blade 3, is positioned farther away from the rotation axis 8 of the radial blade wheel than point B, where the second end plate 2 meets the outer edge 7 of the blade 3. With such a solution, it is possible to affect the pressure prevailing at the outer edge of the blade. When the radial distance from the rotation axis to the outer edge of the blade is not constant, the pressure prevailing in different parts of the outer edge can be evened out in a desired manner. However, according to the invention, this is not necessary in all embodiments. Instead of shaping the outer edge 7 stepped (as in FIG. 4), the outer edge can be made straight, either in such a way that it is parallel to the rotation axis 8 (i.e. point A and point B are located at the same distance from the rotation axis) or in such a way that the outer edge is straight but bevelled (with no step), in which case point A and point B are located at different distances from the rotation axis, as in FIG. 4. Alternative solutions like this are also applicable to the embodiments shown in FIGS. 5 and 6.

The radial blade wheel according to the invention is also suitable for use in a fan housing (static diffuser), which is responsible for converting dynamic pressure to static pressure. However, in connection with known radial blade wheels, this does not take place with sufficiently high efficiency. Owing to the fact that the radial blade wheel according to the invention carries out a larger part of the total pressure increase, the efficiency grows compared with a conventional blade wheel mounted in a casing.

Figure 5:
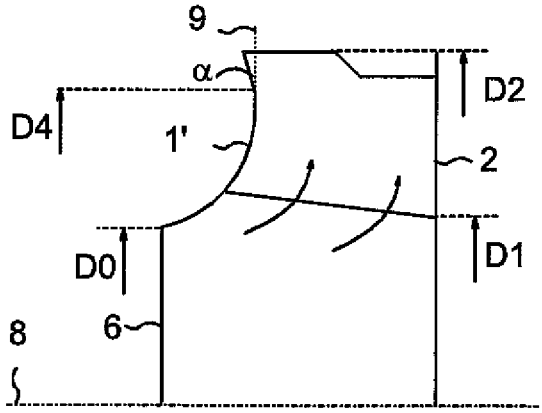
FIG. 5 is a cross-section of the radial blade wheel according to an embodiment of the invention

FIG. 5 is a cross-section of the radial blade wheel according to an embodiment of the invention. The figure shows only the upper half of the radial blade wheel. The embodiment illustrated in FIG. 5 corresponds, for the most part, to the embodiment according to FIG. 4, on account of which the embodiment according to FIG. 5 is described in the following by bringing forth the differences of these embodiments.

In FIG. 5, the radial blade wheel is shaped in such a way that the distance between the end plates increases along with the distance from the rotation axis of the radial blade wheel, at least in part of the outer part with blades. Such an increase in the distance does not have to take place in the whole outer part but the distance may only start growing in the outermost part of the outer part. Alternatively, the distance may start growing as early as in the inner part.

In the embodiment according to FIG. 5, the increase in the distance between the end plates 1' and 2 has been achieved in such a way that the first end plate has been bent outwards at an angle $\alpha$ in relation to a line 9, which intersects the rotation axis 8 of the radial blade wheel perpendicularly. In this way, a lower outflow velocity is achieved from the radial blade wheel, which results in higher efficiency and the radial blade wheel being more suitable to be mounted in apparatuses.

D0 shown in FIG. 5 is the diameter of the opening of the first end plate 1'. In practice, it has been proven preferable to position the starting point of the first end plate's bend outwards at a diameter D4, which is at least about 20% greater than D0 (D4>1.2*D0). Owing to the outer part being provided with blades 3, angle $\alpha$ can be made greater than in known solutions without the flow being loosing contact with the end plate 1' at the bend of the end plate 1'. In practice, this angle $\alpha$ may be 0° to 40°, depending on the dimensions of the radial blade wheel. A solution where the distance between the end plates starts growing at the diameter at which the outer part with blades starts has turned out to work. This is achieved for example when D4=D3. According to the invention, it is, however, possible that the distance between the end plates starts growing at the diameter D4, which is greater or smaller than the diameter D3, at which the outer part with blades starts.

Instead of the first end plate 1' having an outer part which is straight but bent at an angle, as in FIG. 5, this portion may be curved away from the second end plate 2.

Figure 6:
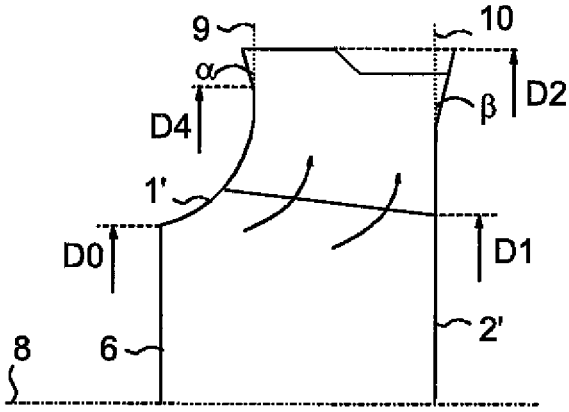
FIG. 6 is a cross-section of the radial blade wheel according to an embodiment of the invention.

FIG. 6 is a cross-section of the radial blade wheel according to an embodiment of the invention. The figure shows only the upper half of the radial blade wheel. The embodiment illustrated in FIG. 6 corresponds, for the most part, to the embodiment according to FIG. 4, on account of which the embodiment according to FIG. 5 is described in the following by bringing forth the differences of these embodiments.

The radial blade wheel shown in FIG. 6 has a first end plate 1' formed in accordance with the description given in connection with FIG. 5. Contrary to the embodiment of FIG. 5, also a second end plate 2' in FIG. 6 is formed in such a way that its outer portion is bent outwards at an angle $\beta$ in relation to a line 10, which intersects perpendicularly the rotation axis 8 of the radial blade wheel. Since both end plates are bent or curved away from each other, the distance between the end plates grows faster in the direction away from the rotation axis 8.

The starting point where the bend of the second end plate 2' starts may be at the diameter D4, at which the first end plate's bend outwards starts. Alternatively, the second end plate's bend outwards may start at a diameter which is greater or smaller than the diameter D4, where the first end plate's bend outwards starts.

Owing to the outer part being provided with blades, angle β can be made greater than in known solutions without the flow loosing contact with the second end plate 2' at the bend. In practice, this angle β may be 0° to 40°, depending on the dimensions of the radial blade wheel.

Instead of the second end plate 2' having an outer part which is straight but bent at an angle, as in FIG. 6, this end may be curved away from the first end plate 1'.

The figures and the related description are only intended to illustrate the invention by way of examples without restricting the scope of the invention thereto. It will be obvious to a person skilled in the art that the scope of the invention may include modifications in relation to these examples.

The invention claimed is:

1. A radial blade wheel comprising:

a first and a second end plate arranged at a mutual distance from each other, the first end plate having an opening which allows inflow to the radial blade wheel, and blades arranged between the first and the second end plate and joined to the first and the second end plate, whereby the outer edges of the blades as well as the first and the second end plate delimit openings allowing outflow from the radial blade wheel, wherein the radial blade wheel comprises:

an inner part with blades, in which curvature of the blades is shaped to bring motion energy to the flowing particles while the radial blade wheel is rotating, and an outer part with blades, in which curvature of the blades is shaped not to bring motion energy to the flowing particles while the radial blade wheel is rotating, wherein the curvature of the blades in the outer part with blades is shaped in such a way that U*Cu=constant, wherein U is the peripheral velocity and Cu is the absolute velocity of a particle along the blade, projected in the direction of the peripheral velocity.

2. A radial blade wheel according to claim 1, wherein:

the curvature of the blades in the inner part is shaped in such a way that the blade angle increases along with the growing distance from the rotation axis of the radial blade wheel, and the curvature of the blades in the outer part is shaped in such a way that the blade angle decreases along with the growing distance from the rotation axis of the radial blade wheel.

3. A radial blade wheel according to claim 1, wherein an outer diameter of the outer part with blades is approximately 10% to 20% greater than a diameter at which the inner part turns into the outer part.

4. A radial blade wheel according to claim 3, wherein the outer diameter of the outer part with blades is 14% greater than a diameter at which the inner part turns into the outer part.

5. A radial blade wheel according to any one of claim 1, wherein the distance between the end plates grows in at least part of the outer part with blades along with the growing distance from the rotation axis of the radial blade wheel.

6. A radial blade wheel according to any one of claim 1, wherein the first end plate is bent away from the second end plate, starting from a diameter, which is at least about 20% greater than a diameter of the opening of the first end plate.

7. A radial blade wheel according to claim 1, wherein the angle between an outer portion of the first end plate and a line intersecting the rotation axis of the radial blade wheel perpendicularly is 0 to 40°.

8. A radial blade wheel according to claim 1, wherein the angle between an outer portion of the second end plate and a line intersecting the rotation axis of the radial blade wheel perpendicularly is 0 to 45°.

9. A radial blade wheel according to any one of claim 1, wherein the greatest outer diameter of at least the first and the second end plate is such that it substantially corresponds to the outer diameter of the outer part of blades.

10. A radial blade wheel according to claim 1, wherein the outer edge of the blades joins to the first end plate at such a distance from the rotation axis of the radial blade wheel that is greater than the distance from the rotation axis of the radial blade wheel at which the outer edge of the blades joins to the second end plate.

* * * * *